US009970207B2

(12) United States Patent
Wasson

(10) Patent No.: US 9,970,207 B2
(45) Date of Patent: May 15, 2018

(54) AIR FRAME EXPANDABLE SHELTER

(71) Applicant: AAR Manufacturing, Inc., Wood Dale, IL (US)

(72) Inventor: Gary D. Wasson, Cadillac, MI (US)

(73) Assignee: AAR Manufacturing, Inc., Wood Dale, IL (US)

( * ) Notice: Subject to any disclaimer, the term of this patent is extended or adjusted under 35 U.S.C. 154(b) by 0 days. days.

(21) Appl. No.: 15/265,031

(22) Filed: Sep. 14, 2016

(65) Prior Publication Data

US 2017/0081867 A1 Mar. 23, 2017

Related U.S. Application Data

(60) Provisional application No. 62/342,306, filed on May 27, 2016, provisional application No. 62/220,368, filed on Sep. 18, 2015.

(51) Int. Cl.
*E04H 1/00* (2006.01)
*E04B 1/342* (2006.01)
(Continued)

(52) U.S. Cl.
CPC ..... *E04H 1/005* (2013.01); *E04B 1/342* (2013.01); *E04B 1/34321* (2013.01);
(Continued)

(58) Field of Classification Search
CPC ..... E04H 1/005; E04H 15/20; E04H 1/02; E04H 2015/201; E04H 2001/1283;
(Continued)

(56) References Cited

U.S. PATENT DOCUMENTS 3,511,529 A * 5/1970 Cutsinger ..... B60P 3/32 296/164
4,310,194 A * 1/1982 Biller ..... B60P 3/32 135/88.13

(Continued)

FOREIGN PATENT DOCUMENTS

CN 101463669 6/2009

OTHER PUBLICATIONS

PCT International Search Report in PCT/US16/51628, dated Dec. 30, 2016.

(Continued)

*Primary Examiner* — Basil Katcheves
*Assistant Examiner* — Joshua Ihezie
(74) *Attorney, Agent, or Firm* — Barnes & Thornburg LLP

(57) ABSTRACT

A portable shelter that is convertible between a collapsed transport configuration and an expanded operational configuration. The shelter includes a container having a wing wall that is selectively pivotal between a closed position and an open position, and an inflatable tent having a flexible inflatable support structure and a flexible cover. When the wing wall is in the open position, the inflatable support structure is selectively inflatable from a collapsed configuration to an operational configuration to thereby support the cover in an expanded operational configuration above the wing wall, such that the cover forms a sheltered space. The inflatable support structure is selectively deflatable from the operational configuration to the collapsed configuration, whereupon the first wing wall may be pivoted to the closed position to store the tent within an internal space of the container, such that the shelter is in the transport configuration.

17 Claims, 10 Drawing Sheets

(51) Int. Cl.
*E04B 1/343* (2006.01)
*E04H 1/02* (2006.01)
*E04H 15/20* (2006.01)
*E04H 1/12* (2006.01)

(52) U.S. Cl.
CPC ..... *E04B 1/34326* (2013.01); *E04B 1/34331* (2013.01); *E04B 1/34384* (2013.01); *E04H 1/02* (2013.01); *E04H 15/20* (2013.01); *E04H 2001/1283* (2013.01); *E04H 2015/201* (2013.01)

(58) Field of Classification Search
CPC .. E04B 1/342; E04B 1/34326; E04B 1/34321; E04B 1/34384; E04B 1/34331
USPC ..... 52/64, 67, 79.5, 66, 69, 71, 79.9, 79.12, 52/122.1, 127.7, 143
See application file for complete search history.

(56) References Cited

U.S. PATENT DOCUMENTS 4,465,316 A * 8/1984 Roisen ..... B60P 3/341 135/88.14
5,170,901 A * 12/1992 Bersani ..... E04B 1/3431 220/1.5
5,226,689 A * 7/1993 Roe ..... B60P 3/34 296/159
5,247,768 A * 9/1993 Russo ..... E04H 15/20 52/2.13
5,570,544 A * 11/1996 Hale ..... E04H 15/20 52/2.11
5,667,267 A * 9/1997 Talucci ..... B60P 3/14 296/26.15
5,761,854 A 6/1998 Johnson et al.
6,029,404 A * 2/2000 Lewis ..... E04B 9/06 52/2.11
6,929,016 B2 * 8/2005 Lee ..... E04H 15/20 135/126
7,695,049 B2 * 4/2010 Colborne ..... B60P 3/14 135/88.13
7,717,290 B2 5/2010 Gerding
7,874,107 B1 * 1/2011 Medley ..... E04B 1/3444 220/1.5
7,941,974 B2 * 5/2011 Vanbasten ..... E04H 9/16 299/12
8,074,818 B2 12/2011 Gerding
8,166,715 B2 5/2012 De Azambuja
8,550,274 B2 10/2013 Gerding
8,770,422 B2 * 7/2014 Cantin ..... E04B 1/3442 206/386
8,794,711 B2 * 8/2014 Paton-Ash ..... E04H 9/04 299/12
9,080,326 B2 * 7/2015 Johnson ..... B60P 3/341
9,120,618 B2 9/2015 Peterson
2005/0284031 A1 * 12/2005 Chen ..... A63G 31/12 52/2.11
2006/0055193 A1 * 3/2006 Colborne ..... B60P 3/14 296/24.3
2006/0113813 A1 * 6/2006 Hicks ..... B60P 3/341 296/26.01
2008/0106137 A1 5/2008 Paton-Ash et al.
2010/0024319 A1 * 2/2010 Pope ..... E04B 1/3431 52/79.9
2011/0132421 A1 * 6/2011 Dolsby ..... E04B 1/3444 135/143
2012/0037622 A1 * 2/2012 Cantin ..... E04B 1/3442 220/23.83
2012/0151851 A1 * 6/2012 Cantin ..... E04B 1/34305 52/79.5
2014/0150352 A1 * 6/2014 Lee ..... E04B 1/3444 52/2.22
2015/0017338 A1 * 1/2015 Wiliams ..... B05B 15/1296 427/421.1

OTHER PUBLICATIONS

PCT Written Opinion of the International Searching Authority in PCT/US16/51628, dated Dec. 30, 2016.
International Preliminary Report on Patentability and Written Opinion of the International Searching Authority of PCT/US2016/051628, dated Mar. 20, 2018.

* cited by examiner

AIR FRAME EXPANDABLE SHELTER

RELATED APPLICATIONS

This application claims the benefit of U.S. Provisional Application 62/342,306, filed May 27, 2016, and U.S. Provisional Application 62/220,368, filed Sep. 18, 2015.

BACKGROUND

The present disclosure is directed to a portable expandable shelter including a rigid-wall container and one or more inflatable tents that can be deployed for the provision of working and living space and that can be collapsed for transport of the shelter.

Prior expandable shelters included a flexible cover supported by rigid metal poles, frames and support members that were heavy and cumbersome to install. The cover needed to be held up by individuals, while the metal support members of the support frame were assembled and maneuvered into place. Once the support members were in place, stretchers needed to be installed to keep the metal support members in place. If the floor of the shelter was not leveled correctly, the metal mechanical support members and/or the cover could become overstressed causing damage to the support structure or cover. In addition, prior expandable shelters provided little head room for users and did not provide sufficient air flow to reduce heat on users.

DETAILED DESCRIPTION

Figure 1:
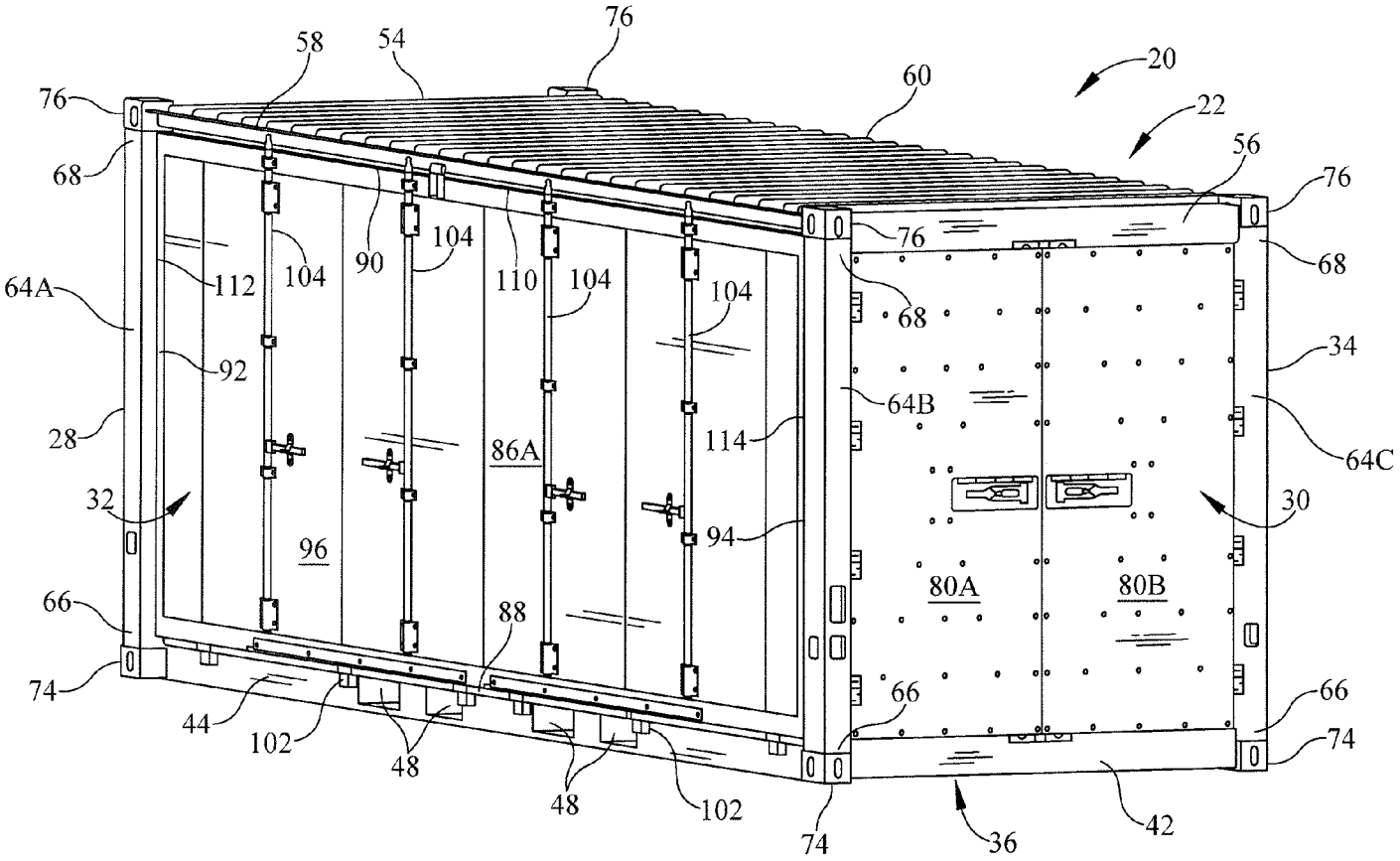
FIG. 1 is a perspective view of a portable expandable shelter shown in the collapsed configuration for transport.
Figure 2:
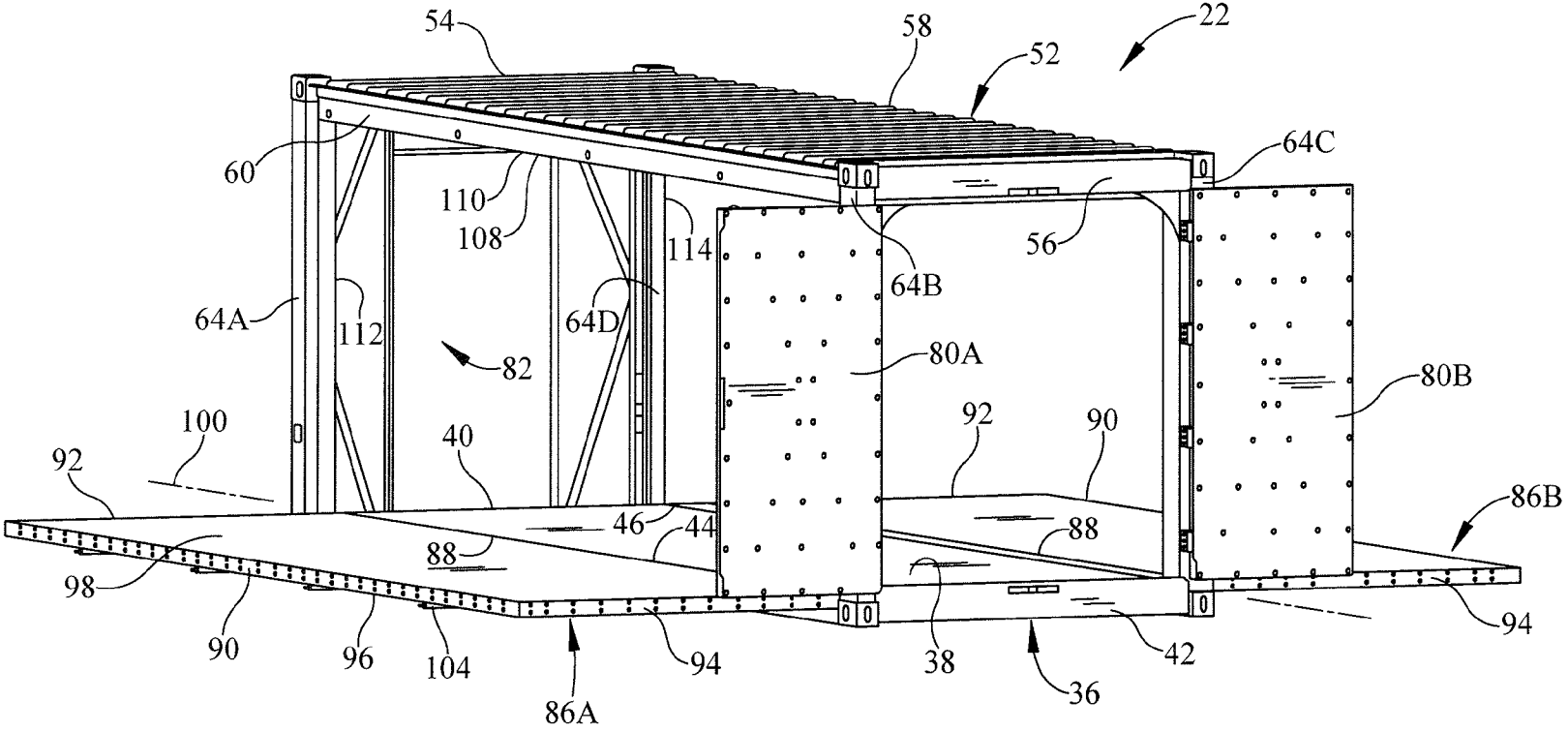
FIG. 2 is a perspective view of the container of the expandable shelter shown with the wing walls of the container in the deployed open position and with the cargo doors in the open position.
Figure 3:
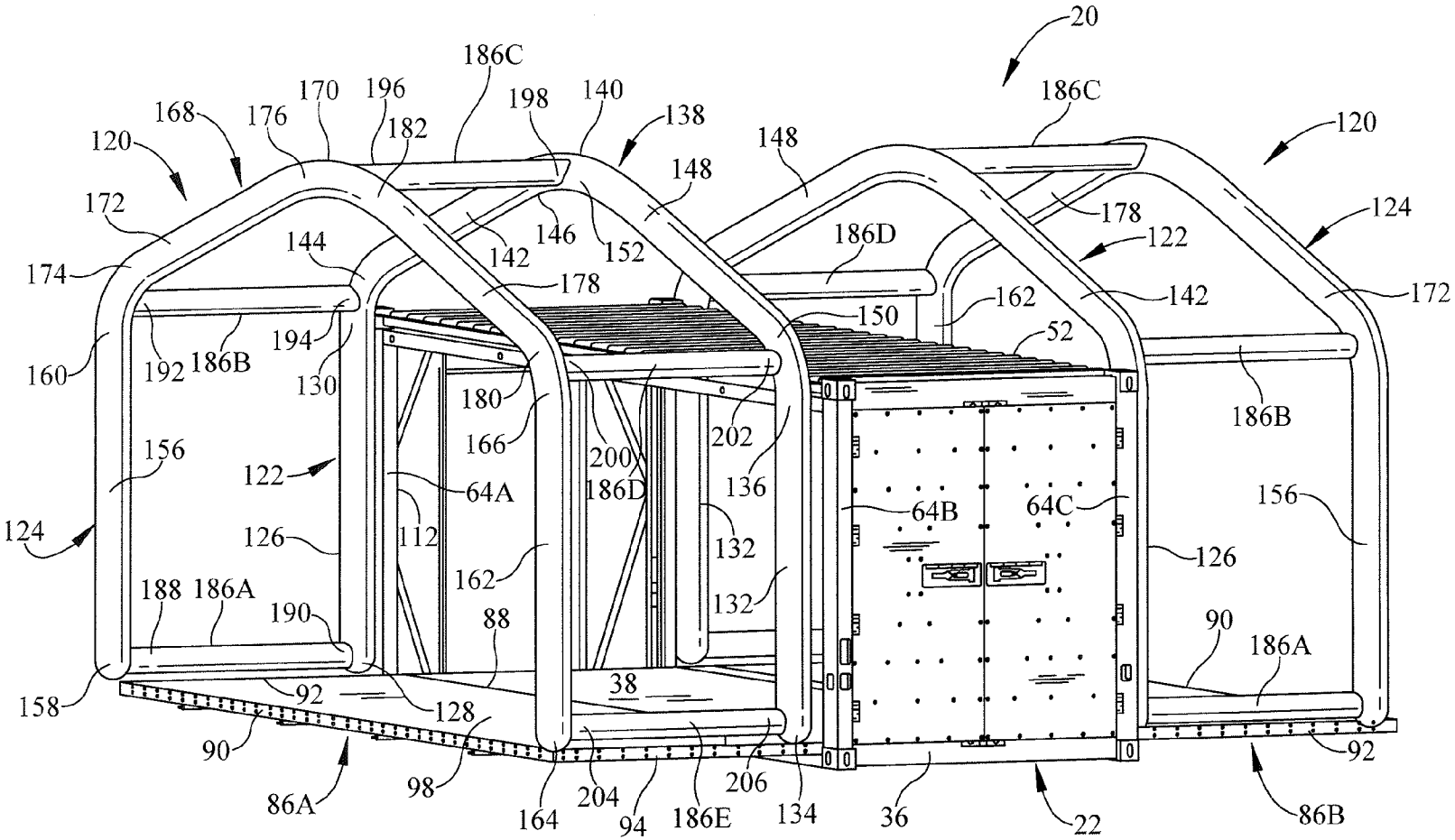
FIG. 3 is a perspective view of the expandable shelter shown with the wing walls of the container in the deployed open position and with the inflatable support structures of the inflatable tents inflated and deployed without showing the flexible cover of the tents for purposes of illustration.
Figure 4:
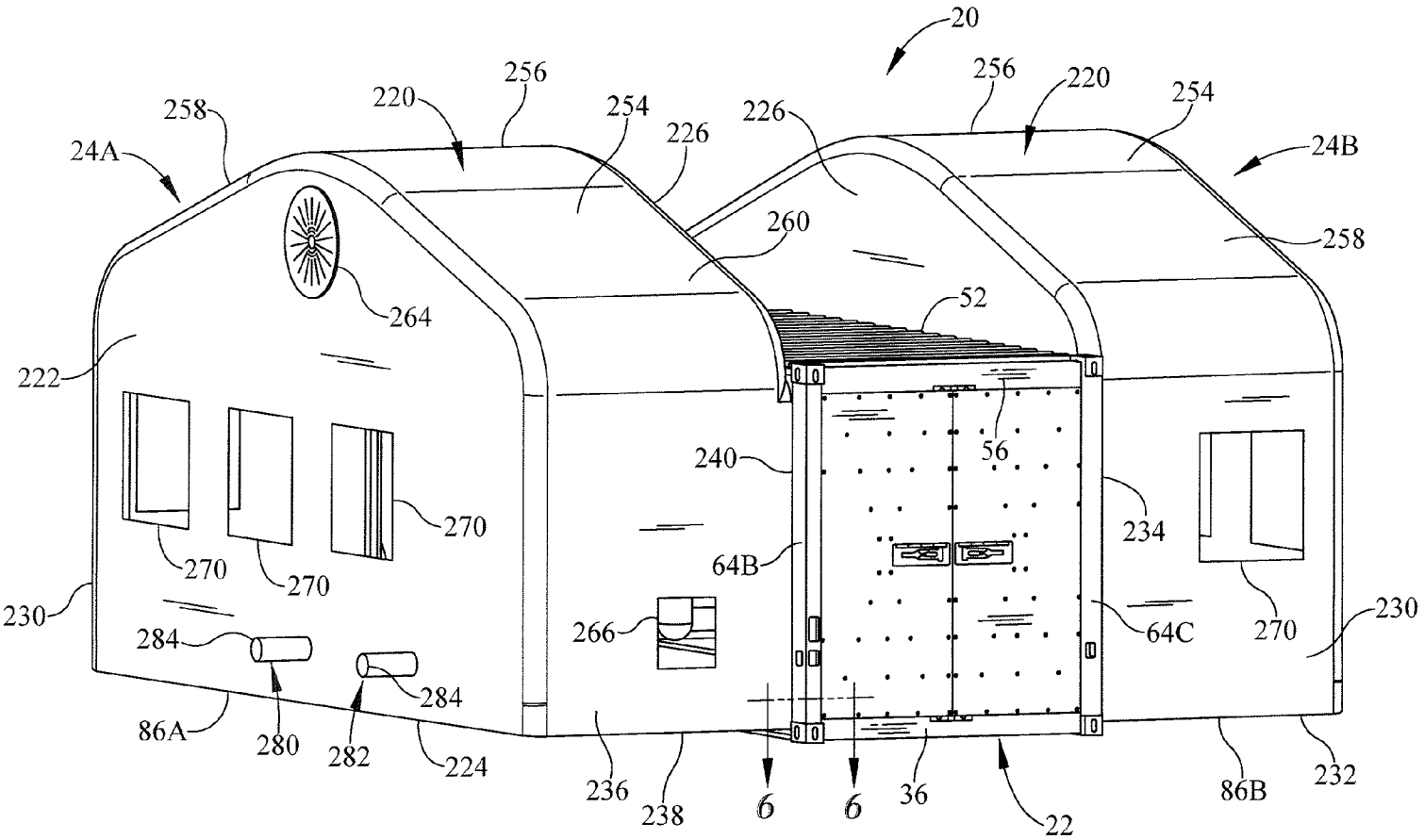
FIG. 4 is a perspective view of the expandable shelter shown in the expanded deployed configuration with the wing walls of the container in the deployed open position and the inflatable tents in the deployed configuration.
Figure 5:
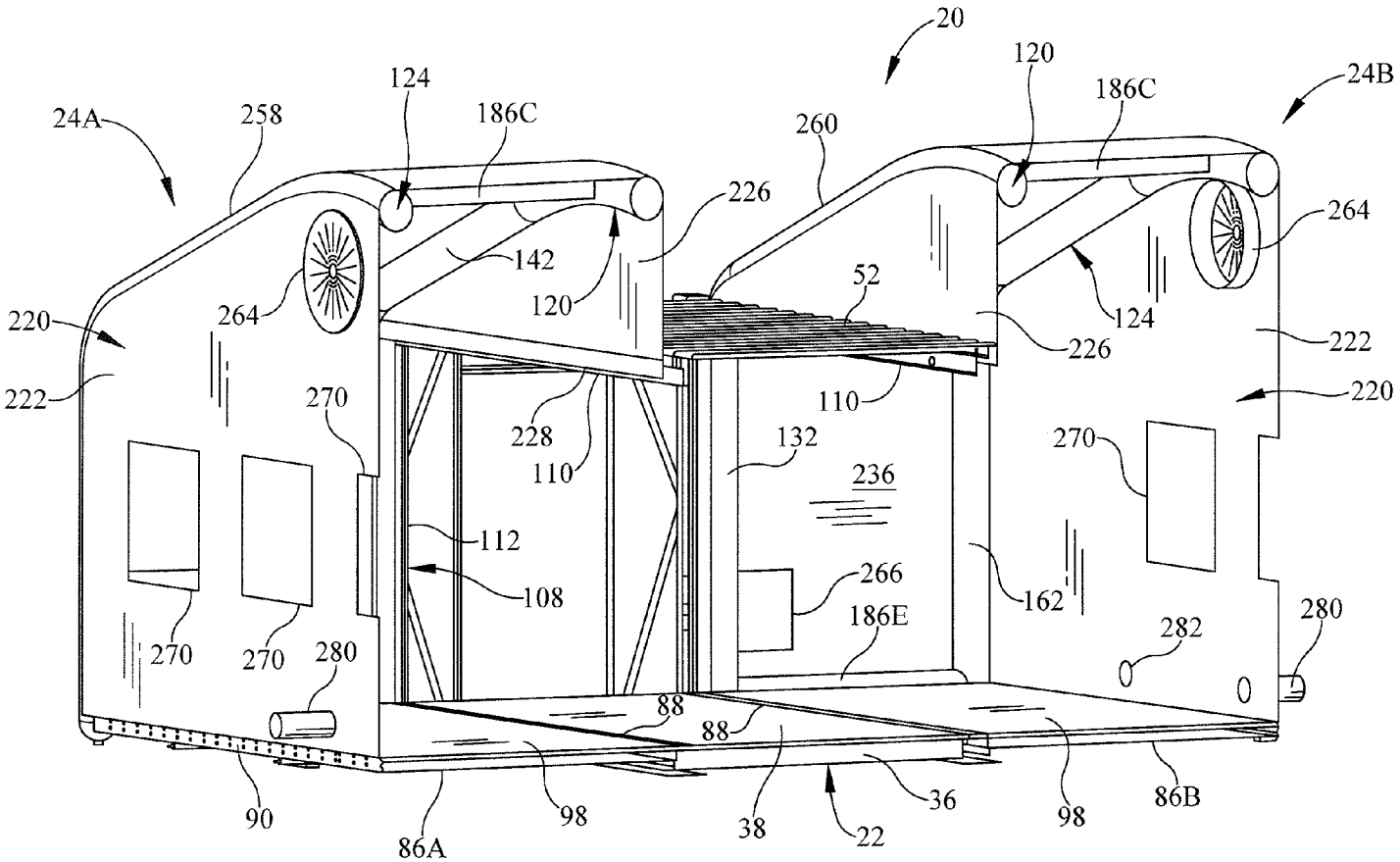
FIG. 5 is a cross sectional perspective view of the expandable shelter shown in the expanded deployed configuration with the wing walls of the container in the deployed open position and the inflatable tents in the deployed configuration.

The present disclosure relates to a portable air frame expandable shelter. Exemplary embodiments of the portable expandable shelter are shown in FIGS. 1-12. The portable expandable shelter 20 is convertible between a collapsed shipping or transport configuration as shown in FIG. 1 and an expanded deployed operational configuration as shown in FIG. 4 for the provision of working and living space within shelter 20. Shelter 20 includes a rigid-wall container 22 as shown in FIG. 2 and one or more air-inflatable tents 24A-B as shown in FIG. 4.

Rigid-wall container 22 extends generally transversely between a first end 28 and a spaced apart and generally parallel second end 30 and extends transversely between a first side 32 and a spaced apart and generally parallel second side 34. Container 22 includes a generally rectangular rigid base 36 with a floor 38 forming the top of base 36. Base 36 includes a first end 40 located at first end 28 of container 22, a second end 42 located at second end 30 of container 22, a first side 44 located at first side 32 of container 22, and a second side 46 located at second side 34 of container 22. First end 40 and second end 42 of base 36 extend generally linearly between first side 44 and second side 46 of base 36. First side 44 and second side 46 of base 36 extend generally linearly between first end 40 and second end 42 of base 36. Base 36 includes a bottom for engagement with a support surface such as the ground or a transport vehicle. Base 36 includes a plurality of pockets 48 located in first side 44 and second side 46 that are adapted to receive the forks of a fork lift.

Container 22 includes a rigid generally rectangular and planar roof 52 that is spaced apart above and generally parallel to base 36 and floor 38. Roof 52 includes a first end 54 located at first end 28 of container 22, a second end 56 located at second end 30 of container 22, a first side 58 located at first side 32 of container 22 and a second side 60 located at second side 34 of container 22. First end 54 and second end 56 of roof 52 extend generally linearly between first side 58 and second side 60 of roof 52. First side 58 and second side 60 of roof 52 extend generally linearly between first end 54 and second end 56 of roof 52.

Figure 6:
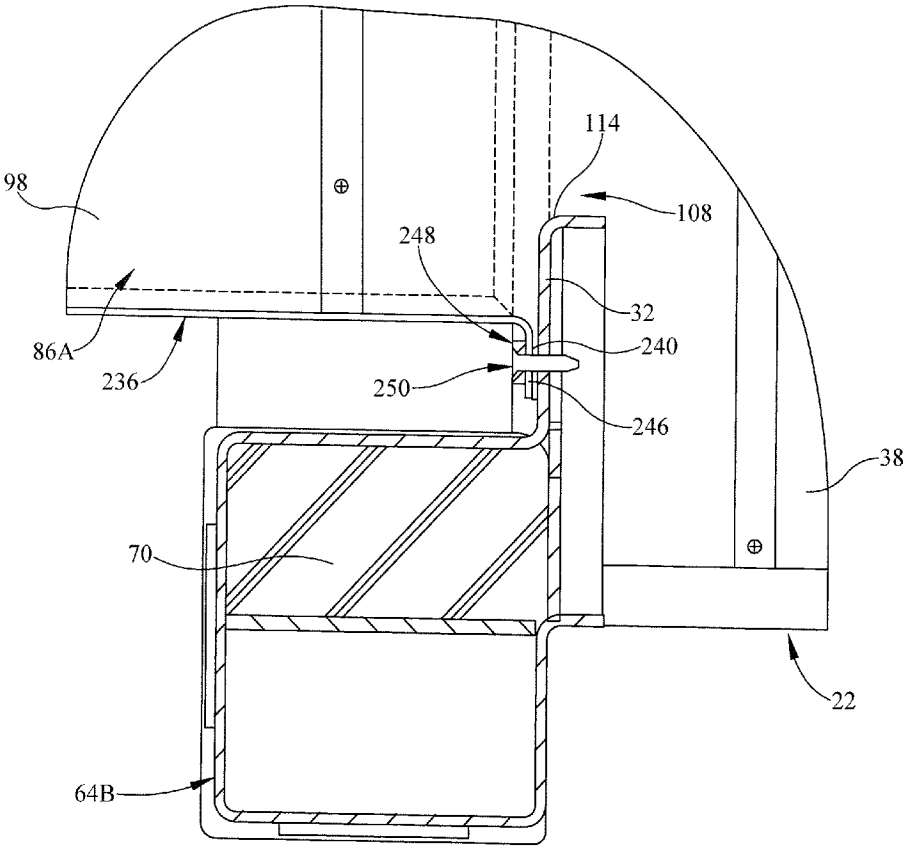
FIG. 6 is a cross sectional view taken along line 6-6 of FIG. 4.
Figure 7:
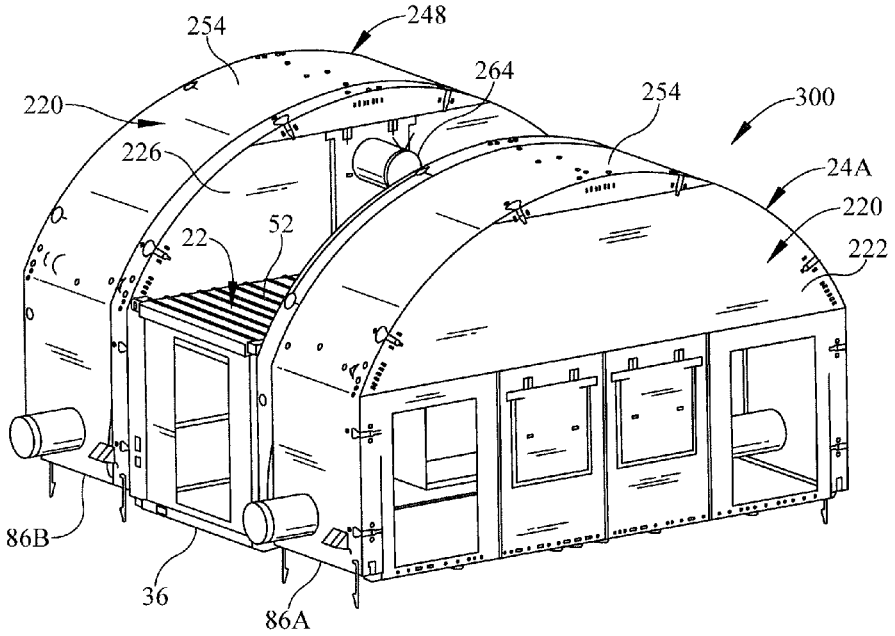
FIG. 7 is a perspective view of another embodiment of the portable expandable shelter shown in the expanded deployed configuration with the wing walls of the container in the deployed open position and the inflatable tents in the deployed configuration.
Figure 8:
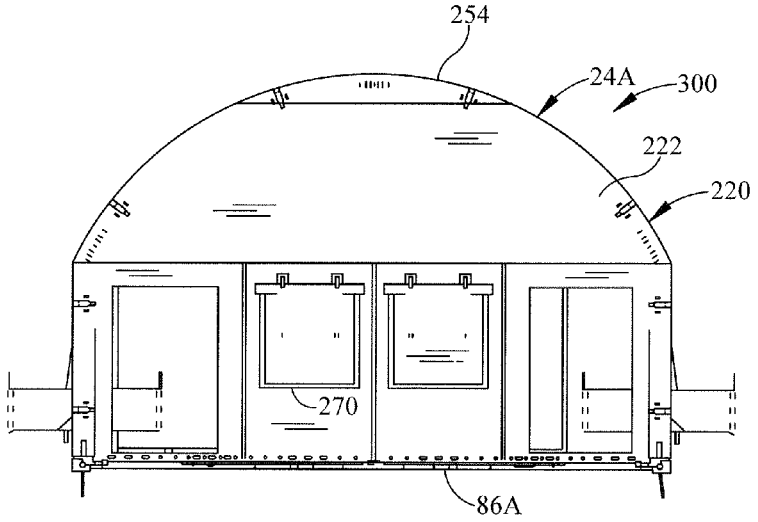
FIG. 8 is a side elevational view of the expandable shelter of FIG. 7 shown in the expanded deployed configuration.
Figure 9:
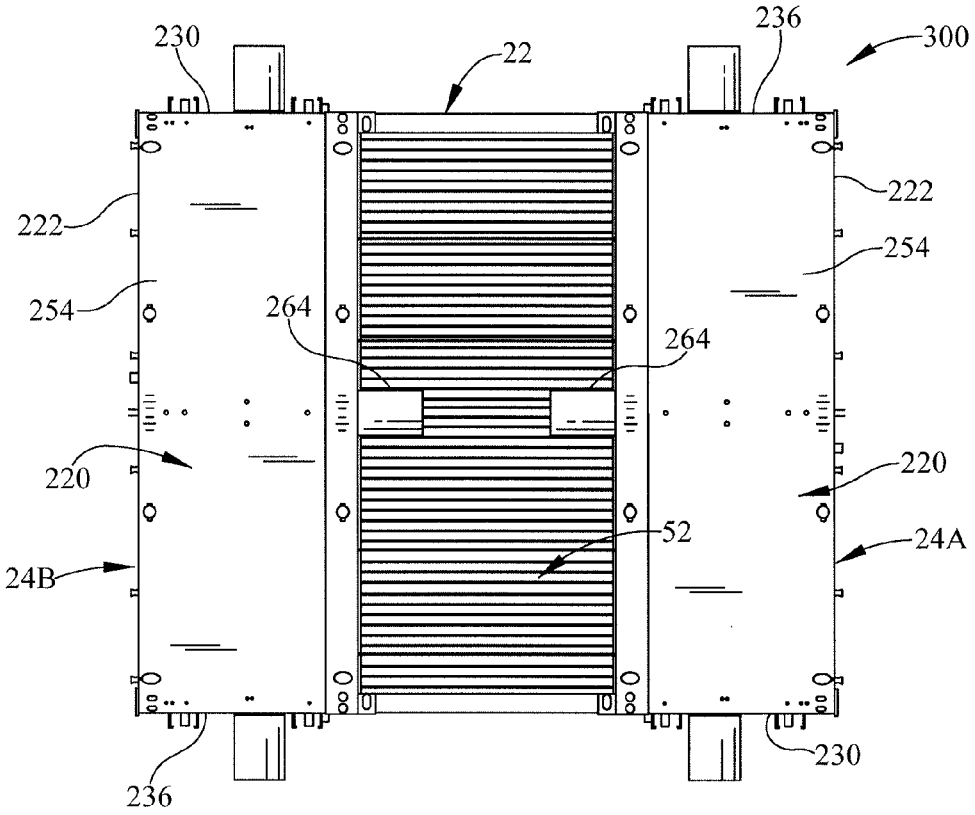
FIG. 9 is a top plan view of the expandable shelter of FIG. 7 shown in the expanded deployed configuration.
Figure 10:
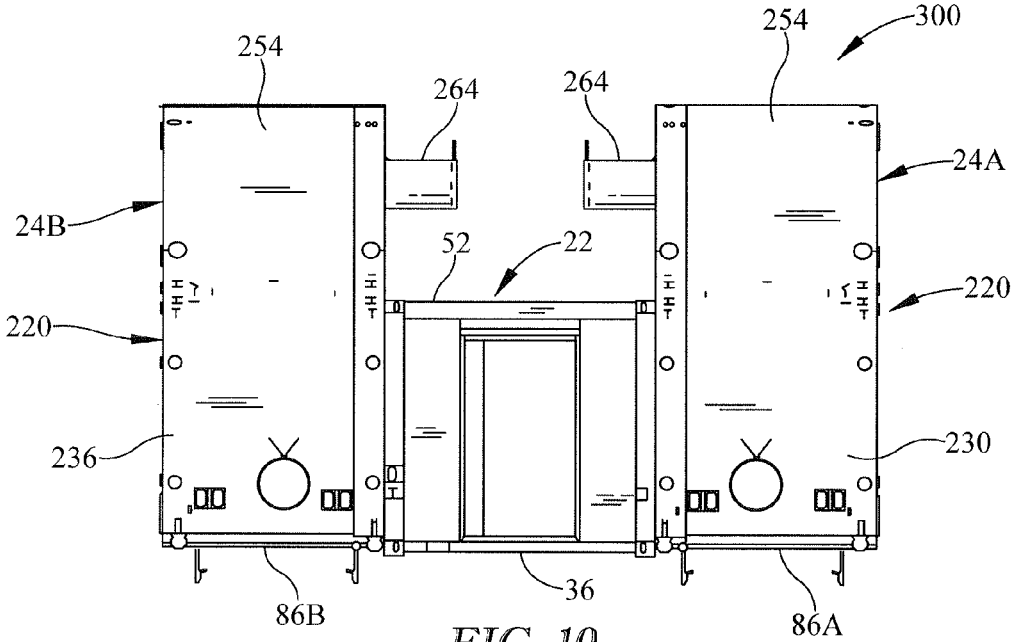
FIG. 10 is an end elevational view of the expandable shelter of FIG. 7 shown in the expanded deployed configuration.

Shelter 20 includes a plurality of elongate and generally linear corner posts 64A-D. Each corner post 64A-D is located at a respective corner of base 36 and roof 52. Each corner post 64A-D extends from a bottom end 66 that is coupled to base 36 to a top end 68 that is coupled to roof 52. As shown in FIG. 6, each corner post 64A-D may comprise a generally rectangular tubular member. Each corner post 64A-D may include a bore filled partially or completely with a thermal insulation material 70. A lower corner block 74 is coupled to bottom end 66 of each corner post 64A-D. An upper corner block 76 is coupled to top end 68 of each corner post 64A-D. Each lower corner block 74 and upper corner block 76 conforms to the International Organization for Standardization (ISO) standards for ISO corner blocks. Each lower corner block 74 and upper corner block 76 includes a plurality of apertures adapted to releasably couple container 22 to other containers or to shipping vehicles such as trucks, trains, ships and aircraft.

As shown in FIGS. 1 and 2, second end 30 of container 22 may include a plurality of cargo doors 80A and B. Cargo door 80A extends between base 36 and roof 52 and is pivotally coupled to second end 30 of container 22 for pivotal movement about a vertical pivot axis located adjacent corner post 64B. Cargo door 80B extends between base 36 and roof 52 and is pivotally coupled to second end 30 of container 22 for pivotal movement about a vertical pivot axis located adjacent corner post 64C. Cargo doors 80A and B may be releasably locked in a closed position as shown in FIG. 1 and may be pivoted to an open position as shown in FIG. 2. As shown in FIG. 2, when cargo doors 80A and B are in the open position, an opening is formed in second end 30 of container 22 into an interior sheltered space within container 22. A personnel door 82 may be located in first end 28 of container 22. Personnel door 82 may be selectively pivoted about a vertical pivot axis between a closed position and an open position to selectively open and close an opening through first end 28 into the interior sheltered space of container 22. Alternatively, second end 30 of container 22 may be formed without any doors or may be formed with one or more windows.

First side 32 of container 22 includes a rigid pivotal wing wall 86A and second side 34 of container 22 may include a rigid pivotal wing wall 86B. If desired, container 22 may include only pivotal wing wall 86A. Wing walls 86A and B may be constructed substantially identical to one another. Wing wall 86A is generally planar and rectangular. Wing wall 86A includes a generally linear proximal edge 88 located adjacent first side 44 of base 36 and a spaced apart and generally parallel and linear distal edge 90. Wing wall 86A also includes a linear first side edge 92 and a spaced apart and generally parallel and linear second side edge 94. First side edge 92 and second side edge 94 extend between and generally perpendicular to proximal edge 88 and distal edge 90. First side edge 92 is located adjacent to or inwardly from corner post 64A and second side edge 94 is located adjacent to or inwardly from corner post 64B, when wing wall 86A is in the closed position. Wing wall 86A includes an exterior surface 96 and an interior surface 98 that is generally planar and that forms a floor when wing will 86A is in the open position.

Proximal edge 88 of wing wall 86A is pivotally coupled to first side 32 of container 22 or first side 44 of base 36 for pivotal movement about a generally horizontal pivot axis 100 between a retracted or closed position as shown in FIG. 1 and an open or deployed position as shown in FIG. 2 by one or more coupling members such as hinges 102. When wing wall 86A is in the closed position as shown in FIG. 1, wing wall 86A is generally vertical and extends between base 36 and roof 52. Wing wall 86A may be releasably locked in the closed position by one or more coupling members such as latches 104 which releasably couple distal edge 90 of wing wall 86A to first side 32 of container 22 or first side 58 of roof 52. As shown in FIG. 2, wing wall 86A may be selectively pivoted about pivot axis 100 from the retracted or closed position to a deployed or open and expanded position as shown in FIG. 2 through an angle of approximately ninety degrees such that interior surface 98 of wing wall 86A is generally horizontal and coplanar with floor 38 of base 36.

When wing wall 86A is in the open position as shown in FIG. 2, a rectangular opening 108 formed in first side 32 of container 22 is open. Opening 108 is formed by a generally linear top edge 110, a generally linear first side edge 112, and a generally linear second side edge 114 that are formed in first side 32 of container 22. Top edge 110 extends generally parallel to and spaced below first side 58 of roof 52 and generally parallel to first side 44 of base 36. First side edge 112 extends generally vertically between first side 44 of base 36 and top edge 110 and is located adjacent to or inwardly from corner post 64A. Second side edge 114 extends generally vertically and linearly between first side 44 of base 36 and top edge 110 and is located adjacent to or inwardly from corner post 64B. A bottom edge of opening 108 is formed by first side 44 of base 36. Wing wall 86A closes opening 108 when wing wall 86A is in the closed position. Second side 34 of container 22 and wing wall 86B may be constructed and operate in the same manner as first side 32 of container 22 and wing wall 86A.

Container 22 may be a standardized shipping container such as an ISO container or intermodal container built to ISO specifications and dimensions. Twenty foot ISO containers have an external length of 19'-10.5", a width of 8'-0", and a height of either 8'-0", 8'-6", or 9'-6". A forty foot ISO container has an external dimension of 40'-0", a width of 8'-0", and a height of either 8'-6" or 9'-6". In addition, the container 22 may comprise a Bicon, Tricon or Quadcon container, each of which has an external width of 8'-0" and a height of 8'-0". Two Bicon containers coupled together lengthwise have an equivalent length of one twenty foot ISO container, three Tricon containers coupled together lengthwise have an equivalent length of one twenty foot ISO container, and four Quadcon containers coupled together lengthwise have an equivalent length of one twenty foot ISO container. Container 22 may also comprise other types and sizes of expandable containers and shelters.

Inflatable tent 24A includes a flexible and inflatable support structure 120. As shown in FIG. 3, inflatable support structure 120 includes a flexible and inflatable support frame 122 and a spaced apart and generally parallel flexible and inflatable support frame 124. Support frame 122 includes a generally vertical and linear first leg 126 that extends between a first end 128 and a second end 130. Support frame 122 also includes a generally vertical and linear second leg 132 that extends between a first end 134 and a second end 136. First end 128 of first leg 126 is coupled to interior surface 98 at a corner of wing wall 86A adjacent the intersection of proximal edge 88 and first side edge 92 of wing wall 86A. First leg 126 extends generally vertically adjacent and parallel to corner post 64A. First end 134 of second leg 132 is coupled to interior surface 98 at a corner of wing wall 86A adjacent the intersection of second side edge 94 and proximal edge 88 of wing wall 86A. Second leg 132 extends generally vertically adjacent and parallel to corner post 64B. Second ends 130 and 136 of first leg 126 and second leg 130 are located at a height or elevation equal to or above the height of roof 52 of container 22.

Support frame 122 includes a beam 138 that is coupled to and extends between second end 130 of first leg 126 and second end 136 of second leg 132. As shown in FIG. 3, beam 138 is generally arch-shaped such that beam 138 includes a peak 140. Beam 138 includes a first inclined rafter 142 that extends generally linearly between a first end 144 and a second end 146. First end 144 of first rafter 142 is coupled to second end 130 of first leg 126. Beam 138 includes a second inclined rafter 148 having a first end 150 and a second end 152. First end 150 of second rafter 148 is coupled to second end 136 of second leg 132. Second end 152 of second rafter 148 is coupled to second end 146 of first rafter 142 at peak 140. Peak 140 may be located at an elevation substantially higher than or above the elevation of a top surface of roof 52. Beam 138 has an inverted V-shaped configuration as shown in FIG. 3, but may be formed as a portion of a circle, oval or other curvilinear configuration. Beam 138 may alternatively extend generally linearly between first leg 126 and second leg 132 if desired.

Inflatable support frame 124 is spaced apart from and generally parallel to inflatable support frame 122 and is constructed in a similar manner as support frame 122 and may be a mirror image of support frame 122. Support frame 124 includes a first leg 156 that extends generally vertically and linearly between a first end 158 and a second end 160. First leg 156 is parallel to and spaced apart from first leg 126 of support frame 122. First end 158 of leg 156 is coupled to interior surface 98 at a corner of wing wall 86A adjacent the intersection of first side edge 92 and distal edge 90 of wing wall 86A. Support frame 124 includes a second leg 162 that extends generally vertically and linearly between a first end 164 and a second end 166. Second leg 162 is spaced apart from and generally parallel to first leg 156 and second leg 132 of support frame 122. First end 164 of second leg 162 is coupled to interior surface 98 at a corner of wing wall 86A adjacent the intersection of second side edge 94 and distal edge 90 of wing wall 86A. Alternatively, the first ends of the legs of support frames 122 and 124 may be located outwardly from wing wall 86A, when wing wall 86A is in the open position, such that the first ends of the legs are supported by the ground or other support structures adjacent to wing wall 86A.

Support frame 124 includes a flexible beam 168 having a peak 170. Beam 168 includes a generally linear and inclined first rafter 172 that extends generally linearly between a first end 174 and a second end 176. First end 174 of first rafter 172 is coupled to second end 160 of first leg 156. Beam 168 includes an inclined second rafter 178 that extends generally linearly between a first end 180 and a second end 182. First end 180 of second rafter 178 is coupled to second end 166 of second leg 162. Second end 182 of second rafter 178 is coupled to second end 176 of first rafter 172 at peak 170. Additional inflatable support frames may be located between support frames 122 and 124 if desired.

Each of the legs and rafters of support frame 122 and of support frame 124 comprise one or more elongate flexible tubes having a hollow bore adapted to sealingly contain a pressurized gas, such as air. The tubes may be circular, rectangular or other configurations in cross section. The legs and rafters of support frame 122 and support frame 124, and the bores thereof, may be coupled in fluid communication with one another. The legs and rafters of support frame 122 may comprise a single tube having a bore that extends from first end 128 of first leg 126 of support frame 122 to first end 134 of second leg 132 of support frame 122. Support frame 124 may comprise a single tube having a bore that extends from first end 158 of first leg 156 of support frame 124 to first end 164 of second leg 162 of support frame 124.

Inflatable support structure 120 includes a plurality of generally linear and elongate horizontal struts 186A-E. Each strut 186A-E comprises an elongate flexible tube having a hollow bore adapted to sealingly contain a pressurized gas, such as air. Strut 186A extends between a first end 188 that is coupled in fluid communication with first end 158 of first leg 156 and a second end 190 that is coupled in fluid communication with first end 128 of first leg 126, such that the bore of strut 186A is in fluid communication with the bores of first leg 156 and first leg 126. Strut 186B extends between a first end 192 that is coupled in fluid communication with support frame 124 adjacent second end 160 of first leg 156 and first end 174 of first rafter 172 and a second end 194 that is coupled in fluid communication with support frame 122 adjacent second end 130 of first leg 126 and first end 144 of first rafter 142, such that the bore of strut 186B is in fluid communication with the bores of first leg 156 and first leg 126.

Strut 186C extends between a first end 196 coupled in fluid communication with beam 168 of support frame 124 at peak 170 and adjacent second ends 176 and 182 of first and second rafters 172 and 178 and a second end 198 coupled in fluid communication with beam 138 of support frame 122 at peak 140 and adjacent second ends 146 and 152 of first and second rafters 142 and 148, such that the bore of strut 186C is in fluid communication with the bores of beams 168 and 138.

Strut 186D extends between a first end 200 that is coupled in fluid communication with support frame 124 adjacent second end 166 of second leg 162 and first end 180 of second rafter 178 and a second end 202 coupled in fluid communication with support frame 122 adjacent second end 136 of second leg 132 and first end 150 of second rafter 148, such that the bore of strut 186D is in fluid communication with the bores of second leg 162 and second leg 132. Strut 186E extends between a first end 204 that is coupled in fluid communication with first end 164 of second leg 162 and a second end 206 that is coupled in fluid communication with first end 134 of second leg 132, such that the bore of strut 186E is in fluid communication with the bores of second leg 162 and second leg 132. Support structure 120 may include additional or fewer struts that extend between support frame 122 and support frame 124 if desired.

The bores of struts 186A-E, and the bores of the legs and rafters of support frames 122 and 124 may all be in fluid communication with one another. Struts 186A-E and the legs and rafters of support frames 122 and 124 may be made from a flexible airtight material such as rubber coated canvas, braided fibers, woven fibers or composite materials such that the inflatable support structure 120 can maintain a selected air pressure within the tubes of support structure 120. Inflatable support structure 120 may include one or more valves that are adapted to control the flow of a gas, such as air, into the bores of the tubes of the inflatable support structure 120 to thereby inflate the inflatable support structure 120, and to control the flow of the gas located within the bores of the tubes of the inflatable support structure 120 out of the inflatable support structure 120 to thereby deflate and collapse the inflatable support structure 120. Inflatable support structure 120 is shown in the inflated and deployed operational configuration in FIG. 3. A source of pressurized air, such as from an air compressor or a blower, may be selectively coupled in fluid communication with the bores of the inflatable support structure 120 to provide pressurized air within the tubes of the inflatable support structure 120 and to inflate the support structure 120 thereby expanding the inflatable support structure 120 from its collapsed configuration to its inflated and deployed configuration.

Tent 24A includes a flexible softwall outer cover 220 that extends over and around inflatable support structure 120. Outer cover 220 includes a flexible generally planar outer end wall 222 that is coupled to and extends along support frame 124 from first end 158 of first leg 156 to first end 164 of second leg 162. Outer end wall 222 extends between first leg 156 and second leg 162 of support frame 124. Outer end wall 222 also extends between distal edge 90 of wing wall 86A and beam 168 of support frame 124. Outer end wall 222 includes an elongate linear bottom edge 224 that is coupled in sealing engagement with distal edge 90 of wing wall 86A to provide a weathertight seal therebetween. Cover 222 also includes a flexible generally planar inner end wall 226 that is spaced apart from and generally parallel to outer end wall 222. Inner end wall 226 is coupled to and extends along beam 138 of support frame 122 from first end 144 of first rafter 142 to first end 150 of second rafter 148. Inner end wall 226 also extends between beam 138 of support frame 122 and roof 52 of container 22 and top edge 110 of opening 108 in container 22. Inner end wall 226 includes a generally linear bottom edge 228 that is coupled in sealing engagement with and that extends along top edge 110 of opening 108 of container 22 to form a weathertight seal therebetween.

Cover 220 includes a flexible generally planar first side wall 230 that is coupled to and extends between first leg 126 of support frame 122 and first leg 156 of support frame 124 and that extends between strut 186A and strut 186B. First side wall 230 includes a horizontal generally linear bottom edge 232 that is coupled in sealing engagement with wing wall 86A adjacent first side edge 92 between proximal edge 88 and distal edge 90 to form a weathertight seal therebetween. First side wall 230 also includes a generally vertical and linear side edge 234 that is coupled in sealing engagement with second side edge 114 of opening 108 of container 22 to form a weathertight seal therebetween. Cover 220 also includes a flexible generally planar second side wall 236 that is coupled to and that extends between second leg 132 of support frame 122 and second leg 162 of support frame 124 and that extends between struts 186D and 186E. Second side wall 236 includes an elongate generally linear bottom edge 238 that extends along and is sealingly coupled to wing wall 86A adjacent second side edge 94 to form a weathertight seal therebetween. Second side wall 236 includes a generally vertical and linear side edge 240 that is sealingly coupled to and that extends along second side edge 114 of opening 108 of container 22 to form a weathertight seal therebetween. Cover 220 is thereby sealingly coupled in weathertight engagement with container 22, along top edge 110, first side edge 112 and second side edge 114 of opening 108 of container 22 and along distal edge 90 and first and second side edges 92 and 94 of wing wall 86A of container 22.

As shown in FIG. 6, side edge 240 of second side wall 236 of cover 220 is sealingly coupled to first side 32 of container 22 by a resilient sealant member 246 such as butyl sealant tape. Sealant member 246 is located between side edge 240 of second side wall 236 and first side 32 of container 22 adjacent second side edge 114 of opening 108 in first side 32 of container 22. An elongate and generally planar batten bar 248 is located adjacent the exterior surface of second side wall 236 at side edge 240 and extends the length of side edge 240 in one or more segments. Side edge 240 of second side wall 236 and sealant member 246 are clamped in engagement with one another and between batten bar 248 and first side 32 of container 22 by a plurality of fasteners 250, such as counter-sunk screws, that extend through batten bar 248, side edge 240 of second side wall 236, sealant member 246 and first side 32 of container 22. Side edge 240 of second side wall 236 is thereby coupled in sealing weathertight engagement with first side 32 of container 22. Cover 220 is coupled in sealing engagement with container 22 along the sides of the perimeter of opening 108 and along the edges of wing wall 86A in a similar manner.

Cover 220 also includes a flexible roof 254 that extends between the top edges of outer end wall 222 and inner end wall 226, and the top edges of first side wall 230 and second side wall 236. Roof 254 extends along and is coupled to beam 138 of support frame 122, beam 168 of support frame 124, and struts 186B, 186C and 186D. As shown in FIG. 4, roof 254 has a generally inverted V-shaped configuration and includes an elongate ridge 256 that extends generally transversely between outer end wall 222 and inner end wall 226, an inclined generally planar first roof panel 258 that extends between first side wall 230 and ridge 256, and an inclined generally planar second roof panel 260 that extends between second side wall 236 and ridge 256. Ridge 256 is located a substantial distance above the elevation of roof 52 of container 22.

Cover 220 comprises a flexible material such as rubber coated canvas, braided fibers, woven fibers, or composite materials. Cover 220 is waterproof and windproof to provide a weathertight open sheltered space within cover 220, when tent 24A is in the expanded and deployed configuration as shown in FIG. 4, that is in communication with the internal space within container 22.

As shown in FIG. 4, roof 254 of cover 220 is located a substantial distance above the elevation of roof 52 of container 22 such that tent 24A provides substantial additional head room, the distance between the floor and the roof, in the sheltered space within tent 24A compared to the head room provided by roof 52 of container 22. Tent 24A also provides a substantial additional volume of sheltered space within tent 24A above the elevation of roof 52 of container 22 for the collection of hot air within the sheltered space of tents 24A-B and container 22, such that the hot air is directed away from personnel and equipment located within the sheltered space. The peaked configuration of roof 254 directs the hot air within the sheltered space toward ridge 256 of roof 254.

A vent 264 may be located in an upper end of outer end wall 222 adjacent ridge 256 of roof 254. Vent 264 includes one or more apertures that provide fluid communication between the sheltered space within tent 24A and the exterior of tent 24A to thereby vent hot air from the sheltered space within tent 24A to the exterior atmosphere and thereby cool the sheltered space within tent 24A and shelter 20. If desired, a vent 264 may also be located in inner end wall 226 adjacent peak 256. Vent 264 may include an electrically powered fan or blower to draw air from within tent 24A to the atmosphere outside of tent 24A. The increased head room and the venting thereof as provided by tent 24A is particularly useful when the sheltered space is used for a kitchen, laundry or other facilities that generate heat.

As shown in FIG. 4, second side wall 236 of cover 220 may include an aperture 266 that is adapted to be coupled to an air circulation device, such as a fan or blower, such that outside air is drawn or blown into the sheltered space of tent 24A to provide air circulation within the sheltered space of tent 24A.

In addition, outer end wall 222, first side wall 230 and second side wall 236 may each include one or more windows 270. Each window 270 may include a clear or translucent flexible plastic sheet or window that is removably coupled to cover 220 by fasteners such as a hook and loop fasteners. Each window 270 may also include a mesh insect screen including a plurality of apertures removably coupled to cover 220 by fasteners such as a hook and loop fasteners, with the mesh screen overlying the interior of the plastic window. Each window 270 may also include an interior panel formed from the same material as cover 220 that overlies the mesh screen and that includes a white internal surface. The interior panel may be secured to cover 220 across the top edge of the interior panel, while the side edges and bottom edges may be removably coupled to the cover 220 with releasable fasteners such as hook and loop fasteners. The interior panel may thereby be selectively rolled up and secured in a rolled-up position such that the interior panel does not block the plastic window or mesh screen. Similarly, an exterior panel made from the same material as cover 220 may overly the exterior of the plastic window. The top edge of the exterior panel may be secured to cover 220 and the side edges and bottom edge of the exterior panel may be removably coupled to cover 220 with releasable fasteners such as hook and loop fasteners. The exterior panel may thereby be selectively rolled up and secured in a rolled-up position such that the exterior panel does not block the plastic window or mesh screen.

As shown in FIG. 4, a wall of cover 220 may include a first sleeve 280 and a second sleeve 282. Sleeves 280 and 282 may be generally tubular. Each sleeve 280 and 282 includes a distal port 284 and a hollow bore that connects distal port 284 in fluid communication with the sheltered space within tent 24A. First sleeve 280 and second sleeve 282 are adapted to be coupled to an environmental control unit (ECU) that is adapted to provide heating, ventilating and air conditioning to the interior sheltered space of tent 24A and shelter 20. An inlet duct of the ECU is adapted to be disposed within first sleeve 280 such that the inlet duct is in fluid communication with the sheltered space to provide airflow into tent 24A. A fastener such as a drawstring or elastic cord located at distal port 284 draws first sleeve 280 in engagement with the inlet duct of the ECU to provide an airtight connection therebetween. The ECU also includes an outlet duct that is adapted to be disposed within second sleeve 282 such that the outlet duct draws air outwardly from within the sheltered space of tent 24A and shelter 20. A fastener such as a drawstring or elastic cord draws distal port 284 of second sleeve 282 in engagement with the outlet duct of the ECU to provide an airtight connection therebetween.

In operation, when shelter 20 is in the collapsed or transport configuration as shown in FIG. 1, shelter 20 may be transported by various modes of transportation including truck, train, ship, airplane, helicopter, forklift and the like. When it is desired to convert or expand shelter 20 to the expanded or deployed configuration as shown in FIG. 4, latches 104 are released and wing wall 86A is pivoted about axis 100 to a substantially horizontal open position wherein interior surface 98 of wing wall 86A acts as a floor that is substantially coplanar with floor 38 of container 22. One or more adjustable support members, such as jacks, may be used to support wing wall 86A on the ground or other support structure in a desired position. A supply of pressurized or compressed air is connected to the bores of inflatable support structure 120 of tent 24A such that pressurized air fills the tubes of inflatable support structure 120 and inflates inflatable support structure 120 from a collapsed deflated configuration to an erect inflated configuration as shown in FIGS. 3 and 4. Inflatable support structure 120 expands cover 220 from a collapsed configuration to an expanded and deployed operational configuration as shown in FIG. 4 as inflatable support structure 120 is inflated. Cover 220 is flexibly and resiliently supported in a deployed configuration by inflatable support structure 120. Inflatable support structure 120 and cover 220 may resiliently bend and flex in response to different loading conditions without any damage to support structure 120 or cover 220. Tent 24B may be converted or deployed from the collapsed shipping or transport configuration to the expanded and deployed operational configuration in connection with wing wall 86B in generally the same manner as tent 24A. Two or more shelters 20, in the deployed configuration, may be coupled together with breezeways to form a shelter complex.

When it is desired to convert shelter 20 from the expanded deployed configuration to the collapsed shipping or transport configuration, air within the tubes of inflatable support structure 120 is vented to the atmosphere to thereby deflate and collapse inflatable support structure 120. As inflatable support structure 120 is deflated, inflatable support structure 120 and cover 220 flexibly collapse on wing wall 86A. Once inflatable support structure 120 and cover 220 are completely collapsed, wing wall 86A is pivoted from the expanded deployed operational position as shown in FIG. 2 to the upright vertical shipping position as shown in FIG. 1 whereupon latches 104 secure wing wall 86A in the vertical shipping position with tent 24A stowed within the internal space of container 22. Tent 24B may be converted from the expanded and deployed operational configuration to the collapsed shipping or transport configuration in connection with wing wall 86B in generally the same manner as tent 24A. Shelter 20, with inflatable tents 24A-B, reduces set-up time, the amount of manpower required for set-up, and provides a more comfortable work environment than prior shelters. Inflatable tents 24A-B may be retrofit to containers of other shelters in place of the originally included covers that were supported by a metal mechanical support structure.

Another embodiment of the portable expandable shelter is shown in FIGS. 7-12 as portable expandable shelter 300. Expandable shelter 300 is constructed similarly to expandable shelter 20 and similar parts are identified with the same reference numbers. Portable expandable shelter 300 is convertible between a collapsed shipping or transport configuration, and an expanded deployed operational configuration as shown in FIGS. 7-10 for the provision of working and living space within shelter 300. Expandable shelter 300 includes a rigid-wall container 22 and one or more air-inflatable tents 24A-B. Each inflatable tent 24A-B includes a flexible and inflatable support structure 120. Each inflatable support structure 120 includes a flexible and inflatable support frame 122 and a spaced apart and generally parallel flexible and inflatable support frame 124.

Figure 11:
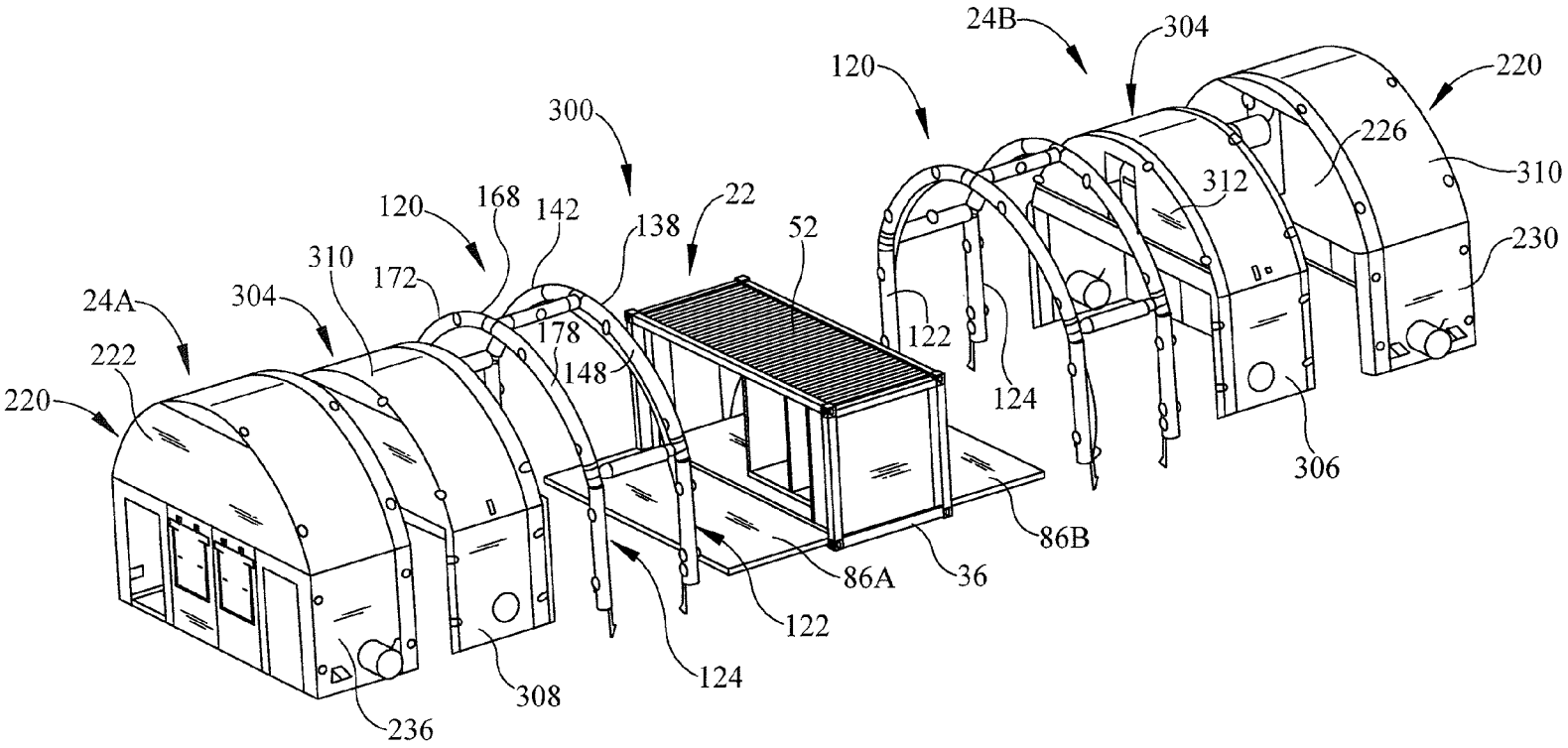
FIG. 11 is an exploded perspective view of the expandable shelter of FIG. 7.
Figure 12:
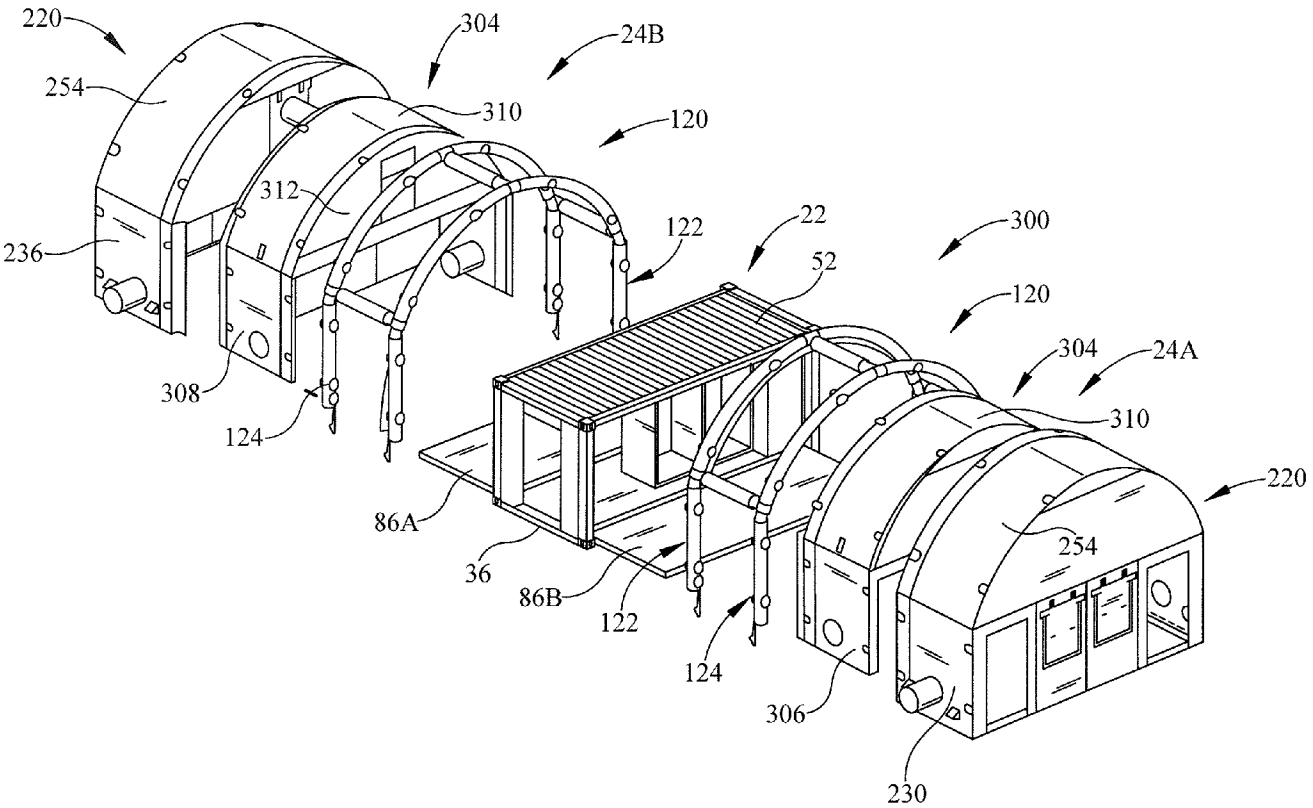
FIG. 12 is an exploded perspective view of the expandable shelter of FIG. 7 taken from another angle.

As shown in FIGS. 11 and 12, beam 138 of support frame 122 is generally arch-shaped and includes inclined first rafter 142 and inclined second rafter 148. First rafter 142 and second rafter 148 are shown in FIGS. 11 and 12 as being generally concavely curved or arched, as opposed to being generally linear as shown in FIG. 3. Support frame 124 includes an arch-shaped beam 168 having inclined first rafter 172 and inclined second rafter 178 that are generally concavely curved or arched as shown in FIGS. 11 and 12, rather than being generally linear as shown in FIG. 3.

As shown in FIGS. 11 and 12, tent 24A of expandable shelter 300 includes flexible softwall outer cover 220 that extends over and around inflatable support structure 120, and a flexible softwall inner cover 304 that is located within outer cover 220 and inflatable support structure 120. Inner cover 304 may be connected to support structure 120 and spaced apart from outer cover 220. Inner cover 304 may be made from the same material as outer cover 220.

Inner cover 304 includes a flexible generally planar first side wall 306 that is coupled to and that extends between first leg 126 of support frame 122 and first leg 156 of support frame 124 and that extends between strut 186A and strut 186B. First side wall 306 is spaced apart from and extends generally coextensively with and parallel to first side wall 230 of outer cover 220. Inner cover 304 includes a flexible generally planar second side wall 308 that is coupled to and that extends between second leg 132 of support frame 122 and second leg 162 of support frame 124 and that extends between struts 186D and 186E. Second side wall 308 is spaced apart from and extends generally coextensively with and parallel to second side wall 236 of outer cover 220.

Inner cover 304 also includes a flexible roof 310 that extends between a top edge of first side wall 306 and a top edge of second side wall 308. Roof 310 extends along and is coupled to beam 138 of support frame 122, beam 168 of support frame 124, and struts 186B, 186C and 186D. Roof 310 has a generally concave or arch shape. Roof 310 is located inside of roof 254 and extends generally coextensively therewith and spaced apart therefrom. Inner cover 304 also includes a flexible generally planar inner end wall 312. Inner end wall 312 is coupled to and extends along beam 138 of support frame 122 from first end 134 of first rafter 142 to first end 150 of second rafter 148. Inner end wall 312 also extends between beam 138 of support frame 122 and roof 52 of container 22 and top edge 110 of opening 108 in container 22. Inner end wall 312 extends generally coextensively with and spaced apart from inner end wall 226 of outer cover 220.

Inflatable tents 24A and 24B of shelter 300 may be constructed substantially identical to one another or as mirror images of one another. Each tent 24A and 24B may individually include one or more windows and one or more doors as desired. Inflatable tents 24A and 24B of expandable shelter 300 are converted between the collapsed or transport configuration for transportation by various modes of transportation and the expanded or deployed configuration in the same manner as inflatable tents 24A and 24B of expandable shelter 20.

What is claimed is:

1. A shelter that is convertible between a collapsed transport configuration and an expanded operational configuration, the shelter comprising:

a container including a base, a roof, a side having an opening, and a first wing wall, the first wing wall including a proximal edge having a first end and a second end and a distal edge having a first end and a second end, the proximal edge of the first wing wall being located adjacent the base, the first wing wall being selectively pivotal between a closed position wherein the first wing wall is adapted to close the opening in the side of the container and a generally horizontal open position;

an inflatable first tent including a flexible inflatable support structure and a flexible cover, the support structure including a flexible first support frame having a first leg, a second leg, and a beam extending between the first leg and the second leg of the first support frame, the first leg, second leg, and beam of the first support frame each comprising a tube adapted to contain pressurized gas, and a flexible second support frame having a first leg and a second leg, the cover including a roof, an outer end wall, and an inner end wall;

the inflatable support structure being selectively inflatable to an expanded operational configuration, when the first wing wall is in the open position, to thereby support the cover in an expanded operational configuration wherein the cover forms a sheltered space above the first wing wall, the inflatable support structure being selectively deflatable to a collapsed configuration such that the first wing wall may be pivoted to the closed position:

whereby when the first wing wall is in the open position and the inflatable support structure is in the operational configuration, the first leg of the first support frame is located adjacent the first end of the proximal edge of the first wing wall, the second leg of the first support frame is located adjacent the second end of the proximal edge of the first wing wall, the first leg of the second support frame is located adjacent the first end of the distal edge of the first wing wall, the second leg of the second support frame is located adjacent the second end of the distal edge of the first wing wall, the beam of the first support frame is at least partially located at an elevation that is higher than the roof of the container, the roof of the cover is supported by the beam of the first support frame such that the roof of the cover is at least partially located at an elevation that is higher than the roof of the container, the outer end wall of the cover extends along the distal edge of the first wing wall and between the first leg and the second leg of the second support frame and is connected to the first wing wall, the inner end wall of the cover extends between the beam of the first support frame and the container, and the first wing wall forms a generally horizontal floor for the sheltered space within the cover.

2. The shelter of claim 1 wherein the second support frame comprises a tube adapted to contain pressurized gas.

3. The shelter of claim 1 wherein the second support frame of the support structure includes a beam extending between the first leg and the second leg of the second support frame, the first leg, second leg and beam of the second support frame each comprising a tube adapted to contain pressurized gas.

4. The shelter of claim 3 wherein, when the support structure is in the operational configuration, the beam of the second support frame is at least partially located at an elevation that is higher than the elevation of the roof of the container.

5. The shelter of claim 4 including a strut extending between the beam of the first support frame and the beam of the second support frame, the strut being located at an elevation that is higher than the roof of the container when the support structure is in the operational configuration, the strut supporting the roof of the cover.

6. The shelter of claim 3 including one or more struts extending between the first support frame and the second support frame, each strut comprising a tube adapted to contain pressurized gas.

7. The shelter of claim 6 wherein the tubes of the first support frame, the tubes of the second support frame, and the tubes of the struts are in fluid communication with one another.

8. The shelter of claim 3 wherein the inner end wall of the cover of the first tent extends downwardly from the beam of the first support frame toward a top edge of the opening in the side of the container, and the outer end wall of the cover extends downwardly from the beam of the second support frame toward the distal edge of the first wing wall, when the first wing wall is in the open position and the support structure is in the operational configuration.

9. The shelter of claim 1 wherein the tubes of the first leg, the second leg, and the beam of the first support frame are in fluid communication with one another.

10. The shelter of claim 1 wherein the beam of the first support frame is generally arch-shaped and includes an inclined first rafter and an inclined second rafter.

11. The shelter of claim 1 wherein, when the first wing wall is in the open position and the support structure is in the operational configuration, the first leg of the first support frame is located adjacent a first side edge of the opening in the side of the container and the second leg of the first support frame is located adjacent a second side edge of the opening in the side of the container.

12. The shelter of claim 1 wherein the first leg and the second leg of the first support frame and the first leg and the second leg of the second support frame are located adjacent respective corners of the first wing wall.

13. The shelter of claim 1 wherein the outer end wall of the cover of the first tent includes a vent, the vent being located at an elevation that is higher than the elevation of the roof of the container when the support structure is in the operational configuration.

14. The shelter of claim 1 wherein the cover of the first tent comprises an outer cover, the first tent including a flexible inner cover adapted to be supported by the inflatable support structure in an operational configuration, the inner cover being spaced apart from the outer cover when the support structure is in the operational configuration.

15. The shelter of claim 1 wherein the container includes a second wing wall, the second wing wall being selectively pivotal between a closed position and an open position, and the shelter comprises an inflatable second tent including a flexible inflatable support structure and a flexible cover, the support structure of the second tent being selectively inflatable to an operational configuration to thereby support the cover of the second tent in an operational configuration, the support structure of the second tent being selectively deflatable to a collapsed configuration such that the second wing wall may be pivoted to the closed position.

16. A method of converting a shelter between a collapsed transport configuration and an expanded operational configuration, the method comprising:

providing a container including a base, a roof, and a wing wall, the wing wall including a proximal edge having a first end and a second end and a distal edge having a first end and a second end, the proximal edge of the wing wall being located adjacent the base, the wing wall being selectively pivotal between a closed position and a generally horizontal open position, and an inflatable tent including a flexible inflatable support structure and a flexible cover, the support structure including a flexible first support frame having a first leg, a second leg, and a beam extending between the first leg and the second leg of the first support frame, the first leg, second lea, and beam of the first support frame each comprising a tube adapted to contain pressurized gas, and a flexible second support frame having a first leg and a second leg, the cover including a roof, an outer end wall, and an inner end wall;

pivoting the wing wall to the generally horizontal open position;

inflating the support structure to an expanded operational configuration to thereby support the cover in an expanded operational configuration above the wing wall such that the cover forms a sheltered space above the wing wall, whereby the first leg of the first support frame is located adjacent the first end of the proximal edge of the wing wall, the second leg of the first support frame is located adjacent the second end of the proximal edge of the wing wall, the first leg of the second support frame is located adjacent the first end of the distal edge of the wing wall, the second leg of the second support frame is located adjacent the second end of the distal edge of the wing wall, the roof of the cover is supported by the beam of the first support frame such that the roof of the cover is located at an elevation that is higher than the roof of the container, the outer end wall of the cover extends along the distal edge of the wing wall and between the first leg and the second leg of the second support frame and is connected to the wing wall, the inner end wall of the cover extends between the beam of the first support frame and a top edge of an opening in the side of the container, and the wing wall forms a generally horizontal floor for the sheltered space within the cover.

17. The method of claim 16 including the steps of:

deflating the support structure from the operational configuration to a collapsed configuration;

pivoting the wing wall to the closed position such that the tent is located within the container.

* * * * *